US005208989A

United States Patent [19]

Sanders

[11] Patent Number: 5,208,989

[45] Date of Patent: May 11, 1993

[54] SIGHT VIEWING APPARATUS

[76] Inventor: Ronald J. Sanders, P.O. Box 658, Floodwood, Minn. 55736

[21] Appl. No.: 756,814

[22] Filed: Sep. 9, 1991

Related U.S. Application Data

[62] Division of Ser. No. 459,544, Jan. 2, 1990, Pat. No. 5,046,277.

[51] Int. Cl.[5] ..... F41G 1/34

[52] U.S. Cl. ..... 33/241; 33/248; 33/246; 42/101

[58] Field of Search ..... 33/245, 248, 246, 241, 33/257, 258; 42/101, 103

[56] References Cited

U.S. PATENT DOCUMENTS

| | | | |
|---|---|---|---|
| 2,392,979 | 1/1946 | Doliden | 33/241 |
| 2,546,242 | 3/1951 | Stinson | 33/241 |
| 3,294,963 | 12/1966 | Carn | 33/241 |
| 3,320,671 | 5/1967 | Rickert et al. | 33/241 |
| 3,834,035 | 9/1974 | Merrill | 33/258 |
| 4,214,371 | 7/1980 | Bush | 33/241 |
| 4,266,873 | 5/1981 | Hacskaylo et al. | 33/241 |
| 4,554,744 | 11/1985 | Huckenberg | 33/241 |
| 4,734,990 | 4/1988 | Sanders | 33/241 |
| 4,859,058 | 8/1989 | Ekstrand | 33/241 |
| 5,025,564 | 6/1991 | Sanders | 33/241 |

*Primary Examiner*—Thomas B. Will

*Attorney, Agent, or Firm*—Peterson, Wicks, Nemer & Kamrath

[57] ABSTRACT

A sight viewing apparatus (10) is disclosed in the preferred form including an extruded tubular portion (12) slideably received on an extruded body portion (56). A lens (36) is captured by first and second extruded collars (42, 44) slideably received within the tubular portion (12). A light bulb (146), spring (148), battery (152), and bolt (154) are received in a first bore (142) in the body portion (56). Light from the enclosed bulb (146) passes through a second bore (144) formed in the body portion (56) and intersecting with the first bore (142) and through removed portions (54, 156) formed in the collar (42) and the tubular portion (12). A lens assembly (96) is attached to a slide (110) by a bolt (106) and dowel pin (108) to allow lateral or windage positioning relative to the front lens (36), and the slide (110) is adjustably positionable on an angular surface (88) to allow elevational positioning relative to the front lens (36). The inside surface of the collar (42) is reflective to reflect the light passing into the tubular portion (12) to illuminate markings (40, 105) of iridescent matter on the lenses (36, 100). Mounting provisions (68) is further provided on the body portion (56) to allow mounting the apparatus (10) on a firearm or the like.

22 Claims, 2 Drawing Sheets

SIGHT VIEWING APPARATUS

This is a divisional of copending application Ser. No. 07/459,544 filed on Jan. 2, 1990, now U.S. Pat. No. 5,046,277.

BACKGROUND

There are presently various optical sight alignment means available for use on firearms and non-firearms such as crossbows, bows, etc. Primarily, most optical lens sights are used on high power firearms because of the magnification extreme, which is not necessarily required on short range, less powerful and less accurate weaponry and because of the trajectory limitations of less powerful weapons. Existing optical sights which do not have magnification or have low magnification are for the most part too expensive for novice use and therefore most novice users of lower power weapons go afield with less than adequate sighting means, which, of course, increases the amount of wounded game animals.

This invention then relates to the making of a high quality, inexpensive optical sight which can be used effectively in all light conditions and can be adapted to most firearms and non-firearms which need extended eye relief mounting and no or low magnification to function effectively in the field.

Although the features of this invention, which are believed to be novel, are set, forth in the claims, details as to its organization and method of operation, together with the further objects and advantages thereof, may be best understood through reference to the following description taken in connection with the accompanying drawings.

DESCRIPTION OF THE DRAWINGS

The illustrative embodiment may best be described by reference to the accompanying drawings where.

Figure 1:
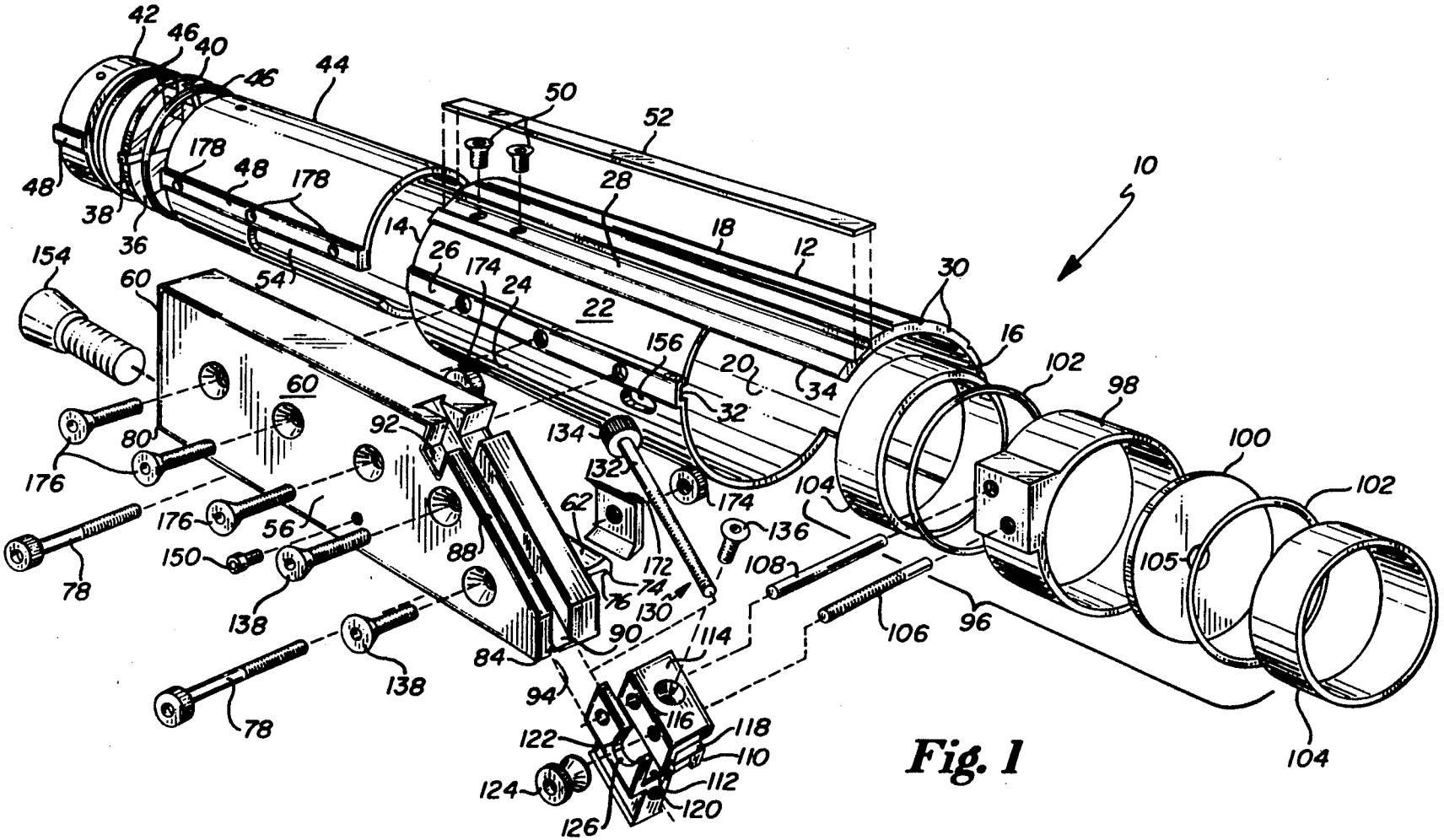
FIG. 1 shows an exploded perspective view of a preferred form of a sight viewing apparatus according to the preferred teachings of the present invention.
Figure 3:
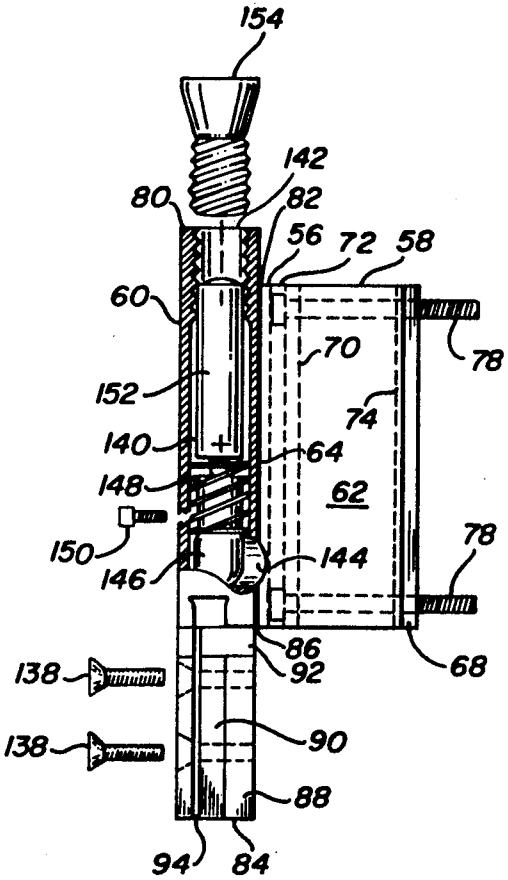
FIG. 3 shows a cross sectional view of the sight viewing apparatus of FIG. 1.
Figure 2:
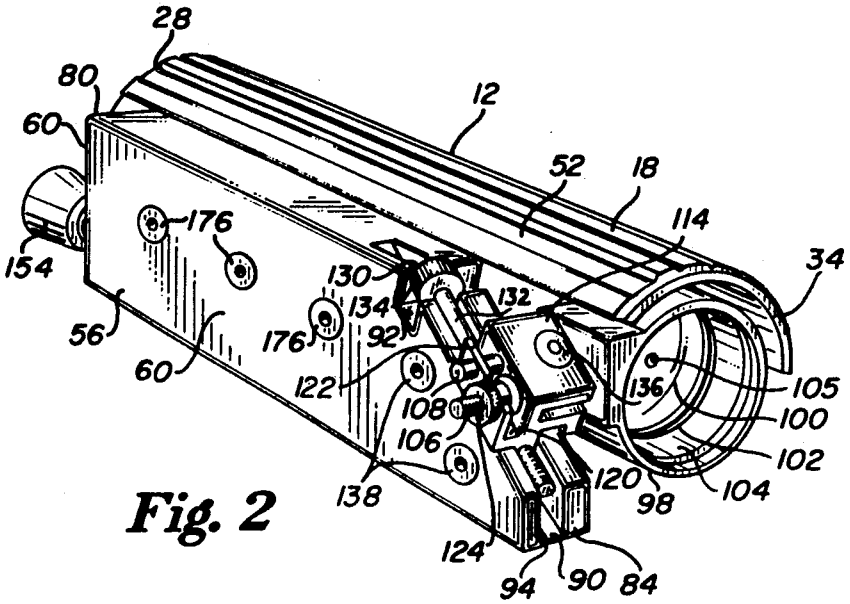
FIG. 2 shows an exploded, perspective view of the sight viewing apparatus of FIG. 1.
Figure 4:
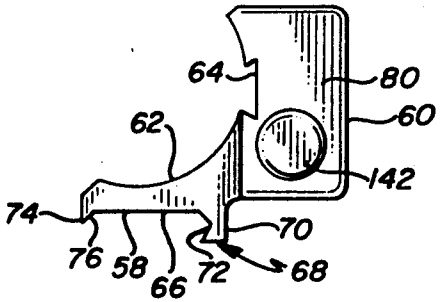
FIG. 4 shows an end view of the sight viewing apparatus of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "inner", "outer", "front", "rear", "windage", "elevation", and similar terms are used herein, it should be understood that these terms have reference only to the structure shown in the drawings as it would appear to a person viewing the drawings and are utilized only to facilitate describing the invention.

DESCRIPTION

A sight viewing apparatus according to the preferred teachings of the present invention is shown in the drawings and generally designated 10. Specifically, apparatus 10 is an extended eye relief viewing and sighting apparatus 10 for sighting distant targets and for use with firearms and with non-firearms where the eye of the user is located a distance from the apparatus 10. In the preferred form, apparatus 10 isolates a specific target area from its immediate surroundings. In the most preferred form, apparatus 10 is used to aim and direct projectile impact and particularly to isolate a target area and aim and direct projectile impact to a specific target within the isolated target area.

Apparatus 10 includes a tubular portion 12 including a first end 14, a second end 16, an outside surface 18 and an inside surface 20. In the most preferred form, a first longitudinal recess 22 is formed on outside surface 18 extending from 130° to 160° on the periphery and a second longitudinal recess 24 is formed on outside surface 18 extending from 180° to 360° on the periphery generally parallel to recess 22 and at the same radial depth. A longitudinally extending dove tail joint 26 is formed intermediate recesses 22 and 24. A third longitudinal recess 28 is formed on outside surface 18 extending from 100° to 120° on the periphery generally parallel to recesses 22 and 24 and at a radial depth less than the depth of recesses 22 and 24. For aesthetic purposes, a plurality of longitudinal indentations 30 are formed at 10° intervals around the periphery on outside surface 18 between recesses 24 and 28. A longitudinally extending positioning channel 32 is formed in inside surface 20 and in the preferred form is located radially aligned with joint 26. It should then be noted that in the most preferred form, tubular portion 12 has a constant longitudinal size and may be extruded and cut to length, with recesses 22, 24, and 28, joint 26, indentations 30, and channel 32 being formed as part of the extrusion. In the preferred form, an axially extending flange 34 is formed extending from 0° to 130° around the periphery and an axial length of approximately 25% of the total length of tubular portion 12 by removing the remaining portion of tubular portion 12.

Apparatus 10 further includes a front lens 36 having an outer, generally circular periphery complementary to and for slideable receipt in inside surface 20 including a radially and longitudinally extending tab 38 complementary to and for slideable receipt in channel 32 to rotationally orient lens 36 with respect to tubular portion 12. Lens 36 includes a silk screened or etched design 40 marked on a surface which in the preferred form is a cross-like marking.

Lens 36 is held in tubular portion 12 adjacent but spaced axially inwardly of first end 14 in a manner disclosed in U.S. Pat. No. 5,025,564 which is hereby incorporated by reference. Specifically, in the most preferred form, a first, annular collar 42 and a second, tubular collar 44 sandwich lens 36 intermediate first and second rubber washer rings 46. Collars 42 and 44 have an outer, generally circular periphery complementary to and for slideable receipt in inside surface 20 and include longitudinally extending positioning bosses 48 complementary to and for slideable receipt in channel 32 to rotationally orient collars 42 and 44 with respect to tubular portion 12. Collars 42 and 44 are held from sliding in tubular portion by screws 50 extending through tubular portion 12 within recess 28 and threadably received in collars 42 and 44. A decal 52 such as wood grain may be positioned in recess 28 to overlie and cover screws 50 to provide an aesthetic appearance. In the most preferred form, collar 44 has a length extending from lens 36 to flange 34 and includes a reflective inner surface. Further, a removed portion 54 is formed in collar 44 on the end opposite lens 36.

Apparatus 10 further includes an L-shaped body portion 56 of a length slightly shorter than tubular portion 12 and having a horizontal leg 58 and a vertical leg 60. The inner surface 62 of legs 58 and 60 includes a configuration generally complementary to and for nesting with a longitudinal section of outside surface 18 of tubular portion 12 and specifically inner surface 62 and a longitudinally extending dovetail bore or groove 64 formed thereon are complementary to and slideably receive recesses 22 and 24 and dovetail joint 26 of tubular portion 12, respectively. The outer surface 66 of leg 58 includes suitable provisions 68 for mounting apparatus 10 to the firearm or other device to be sighted. In the most preferred form, provisions 68 includes a first, longitudinally extending leg 70 including a longitudinally extending V-shaped inner recess 72 and a second, parallel, longitudinally extending leg 74 having an outwardly and longitudinally extending, angular, inner face 76. Mounting provisions 68 may further include first and second laterally extending, spaced bolts 78 extending from leg 70 generally parallel to surface 66 and below and beyond leg 74. In the most preferred form, recess 72 and face 76 are of a size and shape for receipt upon a standard firearm base such as a dove tail scope ring attachment base or a Weaver-style base. Mounting provisions 68 further includes, V-shaped clasps 172 which are sandwiched between leg 74 and the standard firearm base and nuts 174 threadably received on bolts 78. It should then be noted that in the most preferred form, body portion 56 has a constant longitudinal size and may be extruded and cut to length with legs 58 and 60, surfaces 62 and 66, bore 64, and legs 70 and 74 being formed as part of the extrusion.

Tubular portion 12 is selectively prevented from sliding in body portion 56 by screws 176 extending through leg 60 within bore 64 and threadably received in joint 26 of tubular portion 12. Removed portions 178 may be formed in collar 44 in the event that screws 176 extend beyond the inside surface 20 of tubular portion 12.

Leg 58 is partially removed adjacent the first end 80 at 82 approximately 10% of the length of portion 56 and is partially removed adjacent the second end 84 at 86 approximately 30% of the length of portion 56. Second end 84 of leg 60 includes an angular surface 88 extending generally at an acute angle in the order of 30° from leg 58. A longitudinally extending dove tail groove 90 is formed in and parallel to surface 88 of leg 60. A laterally extending channel 92 is formed in and perpendicular to surface 88 of leg 60 intersecting with dovetail groove 90. A pinch slit 94 is formed in leg 60 within groove 90 and extends the axial length of removed portion 82.

Apparatus 10 further includes a rear lens assembly 96. In the most preferred form, assembly 96 includes a generally annular sleeve 98. A lens 100 is captured in sleeve 98 in a similar manner that lens 36 is captured in tubular portion 12 and specifically by sandwiching it intermediate first and second rubber washer rings 102 and first and second collars 104 which are press fit in sleeve 98. In the most preferred form, sleeve 98 and collars 104 may be extruded and cut to length. Lens 100 includes a silk screened or etched design 105 marked on a surface which in the preferred form is a circular marking located concentrically with the periphery of lens 100 such that lens 100 may be mounted in any rotational position. Further, in the most preferred form, sleeve 98, collars 104, and lens 100 are radially smaller than tubular portion 12, collars 42 and 44, and lens 36, respectively. A bolt or threaded shaft 106 and a dowel pin 108 are press fit in sleeve 98 and extend therefrom generally parallel to lens 100 and at an angle from each other corresponding to the angle of surface 82.

Apparatus 10 further includes a T-shaped slide 110 including a leg 112 extending generally perpendicularly from and intermediate a head portion 114. Leg 112 is dove tail shaped and of a size and shape complementary to and for slideable receipt in dove tail groove 90. First and second, spaced, parallel, laterally extending bores 116 are formed in head portion 114 for slideably receiving bolt 106 and dowel pin 108. A longitudinally extending pinch slit 118 is formed in head portion 114 intersecting with bores 116. A longitudinally extending channel 120 is formed in head portion 114 laterally spaced from pinch slit 118 and intersecting with bores 116 to form an upstanding rib 122. A channel nut 124 for threadable receipt on bolt 106 is slideably and rotatably received and captured in a seat 126 formed in rib 122. It should be noted that in the most preferred form, slide 110 may be extruded and cut to length, with leg 112 and head portion 114 including pin slit 118 and channel 120 being formed as part of the extrusion.

Apparatus 10 further includes provisions 130 for adjustably positioning slide 110 on surface 88. In the most preferred form, a bolt 130 is provided having a shank 132 threadably received in leg 112 of slide 110 and of a size for receipt in dove tail groove 90 and having a head 134 of size larger than dove tail groove 90 and for slideable receipt in channel 92 to prevent longitudinal movement of bolt 130 in groove 90 while allowing rotation of bolt 130 in groove 90.

It should then be appreciated that windage adjustment of lens 100 relative to lens 36 may be accomplished by rotating nut 124 captured within seat 126 to move bolt 106 laterally with respect to slide 110. It should then be noted that dowel pin 108 in combination with bolt 106 insure that lens 100 remains in a vertical condition and parallel to lens 36. Provisions 136 such as a screw may be provided to close pinch slit 118 and capture bolt 106 and pin 108 in bores 116.

It should then be appreciated that elevation adjustment of lens 100 relative to lens 36 may be accomplished by rotating bolt 130 captured within channel 92 to move slide 110 along surface 88. It should be noted that due to the angle of surface 88, the elevation of lens 100 will be varied according to the position of slide 110 on surface 88. It should then be noted that the angular positioning of bolt 106 and pin 108 at the same angle as surface 88 insures that lens 100 remains in a vertical condition. Provisions 138 such as screws may be provided to close pinch slot 94 and capture leg 112 of slide 110 in groove 90.

Apparatus 10 further includes provisions 140 for illuminating tubular portion 12 and lens 36 and 100. In the most preferred form, a first longitudinal bore 142 extends in leg 60 from end 80 to a position spaced from end 84 and particularly within the extent of leg 58. A second lateral bore 144 extends in leg 60 from inside surface 62 and intersects with the end of bore 142. A light bulb 146 having a spring 148 located thereon is slideably received in bore 142 and held in position therein such as by a screw 150 threadably received in leg 60 and abutting with bulb 146. A battery 152 may further be slideably received in bore 142 behind spring 148 and retained in bore 142 by a bolt 154 threadably received in the end of bore 142. It can then be appreciated that by tightening bolt 154 in bore 142, bolt 154 will force battery 152 to compress spring 148 and engage bulb 146 and thus make a complete electrical circuit when apparatus 10 is formed of electrically conductive material. Tubular portion 12 further includes a removed portion 156 aligned with removed portion 54 of collar 44 and bore 144 allowing passage of light from bulb 146 into the interior of collar 44 of tubular portion 142.

It should then be noted that the location of bulb 146 within bore 142 is advantageous because the source of light is located outside of tubular portion 12 in a closed, protected or enclosed position, with the light being allowed to pass to the interior of tubular portion 12 by cross bore 144 and removed portions 54 and 156. Thus, bulb 146 can not be viewed and light from bulb 146 may not directly shine through lens 36 or 100 to prevent the target from being alerted. The only light visible would be reflected light from the interior of tubular portion 12. Further, it can be appreciated that markings 40 and 105 are not in a straight line path with light bulb 146. It can then be appreciated that the reflective inner surface of collar 44 allows light passing through bore 144 and removed portions 54 and 156 to reflect light passing into tubular portion 1 and to illuminate markings 40 and 105.

It can be appreciated markings 40 and 105 form front and rear sights for sighting a target along a single sight line extending through tubular portion 12. Further, in a manner disclosed in U.S. Pat. No. 5,025,564, markings 40 and 105 are formed from non-transparent, iridescent matter to self-luminate under low light conditions. Thus, to enhance the light collecting properties of the iridescent matter when daylight is not available, it is only necessary to energize bulb 146 for a time necessary to activate the iridescent matter and then bulb 146 may be de-energized to further reduce the possibility of viewing through tubular portion 12 and of detection of apparatus 10, and re-energized when the iridescent matter no longer is self-illuminated. Further, the life of battery 152 is greatly extended according to the teachings of the present invention than if light 146 were continually energized.

It can then be appreciated that markings 40 and 105 may be also formed by self-luminous material and which does not require exposure to sun or artificial light to luminate, such as tritium. In addition, markings 40 and 105 may be formed of non-transparent material which is not luminating such as ink in the event that apparatus 10 is utilized only in daylight or otherwise lighted environments.

It can be appreciated that markings 40 and 105 may be formed of a very fine silk screened line on lenses 36 and 100 and specifically do not require large bulky objects along the sighting line of apparatus 10 according to the preferred teachings of the present invention. Specifically, markings 40 and 105 of apparatus 10 do not have a tendency to blot out part of the target even at distant targets to make precise sighting utilizing apparatus 10 according to the preferred teachings of the present invention.

It should further be appreciated that apparatus 10 according to the preferred teachings of the present invention is of the type providing an enclosed and elongated see-through passage allowing viewing of the targeted object therethrough which isolates a specific target area from its immediate surroundings while preventing a halo effect in a manner as disclosed in U.S. Pat. No. 4,734,989, which is hereby incorporated by reference. Specifically, tubular portion 12 forms an enclosed and elongated see-through passage, lens 36 forms the front opening, and lens 100 forms the rear opening. As set forth, lens 100 is smaller than lens 36, with sleeve 98, washer rings 102, collars 104, bolt 106, and pin 108 forming a visually opaque, annular perimeter portion extending around lens 100 and generally perpendicular to the viewing direction through tubular portion 12 and of a size generally equal to the viewing size of lens 36 within collars 42 and 44 and washer rings 46. If desired, lens 100 can be made effectively smaller by silk screening a border adjacent its periphery while marking 105 is being silk screened. Further, it can be appreciated that markings 40 and 105 forming the sighting means of the firearm or similar device is located within the enclosed and see-through passage formed by tubular portion 12.

It should be appreciated that tubular portion 12 of apparatus 10 according to the teachings of the present invention is not enclosed due to the removed portion forming flange 34 and the spacing between lens assembly 96 from the remaining parts of apparatus 10. It can then be appreciated that both surfaces of lenses 36 and 100 are open to the atmosphere to prevent condensation on lenses 36 and 100 in even extreme cold or inclement weather as may occur in prior enclosed tubular structures, which condensation may blot out the target or portions thereof.

It can then be appreciated that apparatus 10 according to the preferred teachings of the present invention provides an affordable and viable alternative to the sportsman over precision scope purchases and the sportsman has a better alternative to open sight usage. Apparatus 10 according to the teachings of the present invention is a high quality essential aid for a one shot kill which eliminate the pain and suffering of wounded game animals and careless misuse of weapons and which greatly enhance the sport of hunting by increasing the odds of a higher kill ratio and by reducing wounded game. The sportsman utilizing weaponry equipped with apparatus 10 according to the teachings of the present invention can feel the fulfillment of a successful hunt, making the adventure a worthwhile experience both financially and for peace of mind.

For example, heavy brush and forest, all low light areas, cause a hunter to either over concentrate when aiming or lose concentration totally due to obstructed views while trying to sight-in on moving targets or obscure target areas. Separating the targeted object from its surroundings is one of the most important, if not the most important means of achieving a one shot kill and a one shot kill is an achievement which should be the goal of all serious hunters and the biggest thrill of a stalk and still hunter. It can then be appreciated that apparatus 10 according to the teachings of the present invention is an effective aid in zeroing in on the targeted object and is a means of achieving total focal concentration on the targeted object. Specifically, tubular portion 12, lens 36, and lens assembly 96 play a trick on the viewer's vision which is capitalized on in making the targeted object become clearer and almost seem magnified due to this total focal concentration created by the separation of the targeted object from its surroundings.

Therefore, apparatus 10 according to the teachings of the present invention obtains the advantages of the accuracy of scope sights and the speed of open sights without their drawbacks including the lens orientation required in scope sights and the fogging and moisture beading problems on lenses of scope-type sights.

In its most preferred form, apparatus 10 may be utilized with amounting device adapted to be releasably secured to the sight ramp of slug barrel shotguns such as the type shown and described in U.S. Pat. No. 5,046,277 which is hereby incorporated herein by reference.

It should then be appreciated that apparatus 10 according to the preferred teachings of the present invention includes several unique and independent features producing superior and synergistic results. Such features may be utilized with other forms and types of viewing apparatus than apparatus 10 of the preferred form and/or sight viewing apparatus may be formed according to the teachings of the present invention which do not utilize such features and/or incorporate other features. For example, lens 36 and 100 may incorporate magnification properties, if desired. Similarly, apparatus 10 according to the teachings of the present invention may be mounted to other types of mounting devices than the mounting device of U.S. Pat. No. 5,046,277, may be mounted directly to the firearm or other device, and/or may include other types and forms of mounting provisions 68.

A new sighting apparatus 10 for use on firearms and non-firearms is hereby created according to the preferred teachings of the present invention and can be a valuable accessory used by sportsmen and shooters, a sighting apparatus 10 that is low cost to manufacture and can be mass produced and sold to the consumer at a fraction of the cost of comparable optical sights. This sighting apparatus 10 according to the teachings of the present invention can be formed, shaped and otherwise configured to be used on or in conjunction with other practical equipment such as surveying equipment, laser cutting equipment, etc.

Now that the basic teachings of the present invention have been explained, many extensions and variations will be obvious to one having ordinary skill in the art. For example, although apparatus 10 is shown and described in the preferred form utilized with a shotgun, it will be immediately apparent to one skilled in the art that apparatus 10 according to the teachings of the present invention may be utilized with other types of firearm weaponry such as rifles or pistols, with other types of weaponry such as bows, crossbows, or paint ball guns, or with other types of apparatus requiring fast, precise, and effective sighting and/or aiming.

Thus since the invention disclosed herein may be embodied in other specific forms without departing from the spirit or general characteristics thereof, some of which forms have been indicated, the embodiments described herein are to be considered in all respects illustrative and not restrictive The scope of the invention is to be indicated by the appended claims, rather than by the foregoing description, and all changes which come within the meaning and range of equivalency of the claims are intended to be embraced therein

What is claimed is:

1. Viewing apparatus for sighting distant targets comprising, in combination: a generally enclosed and elongated see-through passage allowing viewing of the target therethrough; means for sighting the target along a single sight line extending through the enclosed and elongated see-through passage; an enclosed source of light located outside the enclosed and elongated see-through passage; means for allowing light from the source to pass into the enclosed and elongated see-through passage and generally without direct viewing from outside of the enclosed and elongated see-through passage; and means located within the enclosed and elongated see-through passage for reflecting the light passing into the enclosed and elongated see-through passage to illuminate the sighting means; wherein the sighting means comprises iridescent matter to self-luminate under low light conditions, with the self-luminating requiring energization of the source of light only for a time necessary to activate the iridescent matter to further reduce the possibility of viewing the source of light from outside the enclosed and elongated see-through passage.

2. The viewing apparatus of claim 1, wherein the sighting means comprises, in combination: a first lens; a second lens, with the first and second lenses located within the enclosed and elongated see-through passage; a first design marked on the first lens; and a second design marked on the second lens.

3. The viewing apparatus of claim 2 wherein the first lens is mounted in the enclosed and elongated see-through passage; and wherein the viewing apparatus further comprises, in combination: means for providing elevation and windage adjustment of the second lens relative to the first lens.

4. The viewing apparatus of claim 3 wherein the adjustment providing means comprises, in combination: an angular surface extending at an acute angle relative to the enclosed and elongated see-through passage; a slide, with the second lens attached to the slide; means for adjustably positioning the slide on the angular surface; and means for laterally positioning the second lens relative to the slid and within the enclosed and elongated see-through passage.

5. The viewing apparatus of claim 4 wherein the adjustably positioning means comprises, in combination: a dovetail groove formed in and parallel to the angular surface; a leg formed on the slide of a shape and size complementary to and for slideable receipt in the dovetail groove; a bolt located in the dovetail groove and threadably received in the leg of the slide; and means for preventing longitudinal movement of the bolt in the dovetail groove while allowing rotation of the bolt in the dovetail groove.

6. The viewing apparatus of claim 5 wherein the bolt includes a head; and wherein the means for preventing longitudinal movement of the bolt comprises, in combination: a channel formed in the angular surface and extending longitudinally across the dovetail groove for slideable receipt of the head of the bolt.

7. The viewing apparatus of claim 6 wherein the lateral positioning means comprises, in combination: a threaded shaft extending from the second lens; a bore formed in the slide for slideably receiving the threaded shaft; a nut for threadable receipt on the threaded shaft; and means for capturing the nut in the slide while allowing rotation of the nut on the threaded shaft.

8. Viewing apparatus for sighting distant targets comprising, in combination: a generally enclosed and elongated see-through passage allowing viewing of the target therethrough; means for sighting the target along a single sight line extending through the enclosed and elongated see-through passage; an enclosed source of light located outside the enclosed and elongated see-through passage; means for allowing light from the source to pass into the enclosed and elongated see-through passage and generally without direct viewing from outside of the enclosed and elongated see-through passage; a body portion; means for slideably mounting the enclosed and see-through passage to the body portion; means for preventing sliding of the enclosed and see-through passage relative to the body portion, with the source of light located within and enclosed by the body portion; and means for mounting the body portion to an apparatus such as a firearm.

9. The viewing apparatus of claim 8 further comprising, in combination: a first bore formed in the body portion; wherein the light allowing means includes a second bore intersecting with the first bore; wherein the source of light comprises, in combination; a light bulb located in the first bore at the intersection with the second bore; a battery located in the first bore behind the light bulb; a spring for biasing the battery from the light bulb; and a bolt threadably received in the first bore behind the battery for pushing the battery to engage the light bulb against the bias of the spring.

10. In a viewing apparatus for sighting distant targets including first and second sights for sighting the target along a single sight line, with the first and second sights being spaced from each other, a device for providing elevation adjustment of the second sight relative to the first sight comprising, in combination: an angular surface extending at an acute angle relative to the first sight; a slide, with the second sight attached to the slide; a dove tail groove formed in and parallel to the angular surface; a leg formed on the slide of a shape and size complementary to and for slideable receipt in the dove tail groove; a bolt located in the dovetail groove and threadably received in the leg of the slide; and means for preventing longitudinal movement of the bolt in the dovetail groove while allowing rotation of the bolt in the dovetail groove.

11. The device of claim 10 wherein the bolt includes a head; and wherein the means for preventing longitudinal movement of the bolt comprises, in combination: a channel formed in the angular surface and extending longitudinally across the dovetail groove for slideable receipt of the head of the bolt.

12. The device of claim 11 further comprising, in combination: a threaded shaft extending from the second sight; a bore formed in the slide for slideably receiving the threaded shaft; a nut for threadable receipt on the threaded shaft; and means for capturing the nut in the slide while allowing rotation of the nut on the threaded shaft.

13. The viewing apparatus of claim 10 further comprising, in combination: a generally enclosed and elongated see-through passage allowing viewing of the target therethrough, with the single sight line extending through the enclosed and elongated see-through passage; an enclosed source of light located outside the enclosed and elongated see-through passage; means for allowing light from the source to pass into the enclosed and elongated see-through passage and generally without direct viewing from outside of the enclosed and elongated see-through passage; and means located within the enclosed and elongated see-through passage for reflecting the light passing into the enclosed and elongated see-through passage to illuminate the first and second sights.

14. Viewing apparatus for sighting distant targets comprising, in combination: a generally tubular portion allowing viewing of the target therethrough; means for sighting the target along a single sight line extending through the tubular portion, with the tubular portion having an inside surface and an outside surface; a body portion having an inner surface and an outer surface, with the inner surface of the body portion having a configuration generally complementary to and for nesting with a longitudinal section of the outside surface of the tubular portion; a longitudinally extending dove tail groove formed in one of the inner surface of the body portion and of the longitudinal section of the tubular portion; a longitudinally extending dove tail joint formed in the other of the inner surface of the body portion and of the longitudinal section of the tubular portion, with the dove tail joint being slideably received in the dove tail groove, with the inside surface and the outside surface of the tubular portion having a constant longitudinal size to allow extrusion of the tubular portion; means formed on the outer surface of the body portion for mounting the body portion to an apparatus requiring sighting such as a firearm, with the inner surface, the outer surface, and the mounting means of the body portion having a constant longitudinal size to allow extrusion of the body portion; and means for selectively preventing sliding of the dove tail joint in the dove tail groove.

15. The viewing apparatus of claim 14 wherein the sighting means comprises, in combination: at least a first sight having an outer periphery for slideable receipt in the inside surface of the tubular portion; a longitudinal groove formed in one of the inside surface of the tubular portion and the outer periphery of the first sight; and a longitudinal tab formed in the other of the inside surface of the tubular portion and the outer periphery of the first sight, with the tab being slideable in the groove for rotationally orientating the first sight within the tubular portion.

16. The viewing apparatus of claim 14 further comprising, in combination: an enclosed source of light located outside the tubular portion; means for allowing light from the source to pass into the tubular portion and generally without direct viewing from outside of the tubular portion; and means located within the tubular portion for reflecting the light passing into the tubular portion to illuminate the sighting means.

17. The viewing apparatus of claim 16 wherein the sighting means comprises, in combination: at least a first sight having an outer periphery for slideable receipt in the inside surface of the tubular portion; a longitudinal groove formed in one of the inside surface of the tubular portion and the outer periphery of the first sight; and a longitudinal tab formed in the other of the inside surface of the tubular portion and the outer periphery of the first sight, with the tab being slideable in the groove, for rotationally orientating the first sight within the tubular portion.

18. In a viewing apparatus for sighting distant targets including first and second sights for sighting the target along a single sight line, with the first and second sights being spaced from each other, a device for providing windage adjustment of the second sight relative to the first sight comprising, in combination: a slide positioned relative to the first sight; a threaded shaft extending from the second sight; a bore formed in the slide for slideably receiving the threaded shaft; a nut for threadable receipt on the threaded shaft; and means for capturing the nut in the slide while allowing rotation of the nut on the threaded shaft.

19. The device of claim 18 further comprising, in combination; a dowel pin extending from the second sight parallel to and spaced from the threaded shaft; and a bore formed in the slide for slideably receiving the dowel pin.

20. The device of claim 19 further comprising, in combination: an angular surface extending at an acute angle relative to the first sight, and means for adjustably positioning the slide on the angular surface; wherein the second sight comprises a lens, with the threaded shaft and the dowel pin extending generally parallel to the lens and at an angle from each other corresponding to the angle of the angular surface.

21. The device of claim 18 wherein the capturing means comprises, in combination: a longitudinally extending channel formed in the slide, intersecting with the bore, and forming an upstanding rib; and a seat formed in the rib, with the nut comprising a channel nut slideably and rotatably received and captured in the seat.

22. The device of claim 18 wherein the capturing means comprises, in combination: a longitudinally extending pinch slit formed in the slide and intersecting with the bore; and means for closing the pinch slit for capturing the threaded shaft in the bore.

* * * * *

UNITED STATES PATENT AND TRADEMARK OFFICE

CERTIFICATE OF CORRECTION

PATENT NO. : 5,208,989

DATED : May 11, 1993

INVENTOR(S) : Ronald J. Sanders

It is certified that error appears in the above-indentified patent and that said Letters Patent is hereby corrected as shown below:

Column 1, line 29, after "set" delete --,--.

Column 3, line 35, after "includes" delete --,--.

Column 5, line 33, cancel "1" and substitute therefor --12--.

Column 7, line 11, cancel "amounting" and substitute therefor --a mounting--.

Column 7, line 61, after "restrictive" insert --.--.

Column 7, line 65, after "therein" insert --.--.

Column 8, line 16, cancel "ing" and substitute therefor --ion--.

Column 8, line 40, cancel "slid" and substitute therefor --slide--.

Column 10, line 58, after "groove" delete --,--.

Column 11, line 6, cancel ";" and substitute therefor --:--.

Signed and Sealed this

Tenth Day of May, 1994

Bruce Lehman

*Attest:*

BRUCE LEHMAN

*Attesting Officer*

*Commissioner of Patents and Trademarks*